US005336962A

United States Patent [19]

Keller

[11] Patent Number: 5,336,962

[45] Date of Patent: Aug. 9, 1994

[54] CATHODE-RAY TUBE HAVING INTERNAL MAGNETIC SHIELD WITH STRENGTHENING RIBS

[75] Inventor: Raymond E. Keller, Clarks Summit, Pa.

[73] Assignee: Thomson Consumer Electronics, Inc., Indianapolis, Ind.

[21] Appl. No.: 909,522

[22] Filed: Jul. 6, 1992

[51] Int. Cl.[5] ..... H01J 29/06

[52] U.S. Cl. ..... 313/402; 313/479; 313/407

[58] Field of Search ..... 313/402, 479, 313, 407; 315/85; 174/35 R, 35 MS

[56] References Cited

U.S. PATENT DOCUMENTS

| | | | |
|---|---|---|---|
| 3,822,453 | 7/1974 | Shrader | 29/25.14 |
| 4,229,675 | 10/1990 | Matsuki et al. | 313/402 |
| 4,513,221 | 4/1985 | Robbins | 313/402 |
| 4,580,076 | 4/1986 | Shimoma et al. | 313/402 |
| 4,622,490 | 11/1986 | Benway | 313/402 |
| 4,670,686 | 6/1987 | Muenkel et al. | 313/402 |
| 4,758,193 | 7/1988 | Brown | 445/1 |
| 4,792,317 | 12/1988 | Sipsma | 313/479 X |
| 4,882,516 | 11/1989 | Hirata et al. | 313/402 X |

*Primary Examiner*—Donald J. Yusko
*Assistant Examiner*—Ashok Patel
*Attorney, Agent, or Firm*—Joseph S. Tripoli; Dennis H. Irlbeck; Vincent J. Coughlin, Jr.

[57] ABSTRACT

A color cathode-ray tube (CRT) has a rectangular faceplate panel with a major axis and a minor axis. A viewing screen is disposed on an internal surface of the panel. The panel is sealed to a funnel along an edge of a sidewall of the panel. A color selection electrode assembly is spaced from the screen and attached to the sidewall of the panel. An internal magnetic shield has a substantially rectangular base with four corners which is secured to the color selection electrode assembly, and a flange circumscribing an aperture. A substantially continuous shield sidewall extends between the base and the flange. The shield sidewall extends backward along an inner surface of the funnel. The internal magnetic shield is improved by at least two pairs of strengthening ribs which are formed in opposite sides of the shield. The ribs are substantially parallel to the minor axis of the panel and in proximity to the flange of the shield. At least one rib of each pair of ribs extends around two adjacent corners of the shield sidewall.

8 Claims, 4 Drawing Sheets

CATHODE-RAY TUBE HAVING INTERNAL MAGNETIC SHIELD WITH STRENGTHENING RIBS

This invention relates to an internal magnetic shield for a cathode-ray tube (CRT) and, more particularly, to an improved magnetic shield having strengthening ribs formed in a sidewall thereof to prevent inflection, or bending, of the sidewall, especially at the corners of the shield.

BACKGROUND OF THE INVENTION

As disclosed in U.S. Pat. No. 4,670,686, and shown in FIGS. 1 and 2, herein a conventional color CRT 10 has a faceplate panel 12, with a tricolor cathodoluminescent viewing screen 13 on an internal surface thereof, that is sealed to a funnel 14 thereof along an edge 16 of the sidewall of the panel. The CRT 10 has an internal magnetic shield 18 disposed therein proximate an inner surface 20 of the funnel 14. The magnetic shield 18 is fastened by means of a base 19 to a color selection electrode assembly, such as a shadow mask and frame 22 which is attached by mounting studs 24 to the sidewall of the panel 12 and spaced from the screen 13. The inner surface 20 of the funnel 14 has a conductive coating 26 thereon extending along the surface 20 to a predetermined distance from the edge 16. A substantially continuous bowl-like sidewall 27 extends backward from the base 19 of the shield, along the inner surface 20 of the funnel 14, and terminates in a substantially flat rear flange 30. A pair of contact springs 28 are attached to the surface of the flange 30, at the rear of the internal magnetic shield 18, for effecting an electrical connection between the shield and the conductive coating 26. The shield 18 includes an aperture 31 formed through the surface of the flange 30. An indentation or ridge 32 is formed around the flange 30 to prevent improper insertion of the spring 28, as described in the above-referenced patent. As shown in FIG. 2, the springs 28 are located on opposite sides of the flange 30 and are directed parallel to the major axis A—A of the tube 10. A second embodiment of a conventional magnetic shield 18' is shown in FIG. 3. The shield 18' differs from the shield 18 in that V-shaped notches are formed in a sidewall 27' of the shield to extend the aperture 31' in the direction of the major axis A—A. The contact springs 28 are secured to the surface of the flange 30' and extend generally parallel to the minor axis B—B.

Each of the conventional shields 18 and 18' is formed of cold-rolled steel having a thickness within the range of about 0.01 to 0.18 mm. Before the springs 28 are attached, the shields are annealed and blackened to improve their magnetic properties and to reduce reflections. A problem with an internal magnetic shield formed of a continuous sheet of relatively thin steel is that the shield lacks rigidity and is susceptible to handling damage, for example, when the contact springs 28 are affixed to the flanges 30 or 30'. Additionally, it has been determined that a bending force is exerted on the shield from the pressure of the contact springs, when the shield is installed within the funnel 14. This bending force sometimes creates an inflection point or bend at the corners of the shield and, thus, changes the magnetic properties of the shield, or, if severe enough, causes the shield sidewall to collapse sufficiently to intercept a portion of the electron beams. Structural integrity of the magnetic shield can be increased by making the shield out of two or four separate pieces of metal that are formed and welded together. Such a shield structure 118 is shown in FIG. 4 herein where two formed C-shaped pieces 120 and 122 are welded along overlapping seams that extend parallel to the minor axis B—B. V-shaped notches are provided in the shield to extend the aperture 131 along the major axis A—A, and gussets 133 are formed adjacent to each of the V-notches to prevent deformation of the shield pieces 120 and 122. The welded multi-piece shield 118 is inherently stronger than the one-piece, bowl-like shields 18 and 18'; however, the shield 118 is more expensive to manufacture, since it requires the additional welding operation.

SUMMARY OF THE INVENTION

A color cathode-ray tube has a rectangular faceplate panel with a major axis and a minor axis. A viewing screen is provided on an internal surface of the panel which is sealed to a funnel along an edge of a sidewall of the panel. A color selection electrode assembly is spaced from the screen and attached to the sidewall of the panel. An internal magnetic shield has a substantially rectangular base with four corners, which is secured to the color selection electrode assembly, and a flange which circumscribes an aperture. A substantially continuous sidewall extends between the base and the flange. The sidewall of the shield is directed along an inner surface of the funnel. The shield is improved over conventional shields by having at least two pairs of strengthening ribs formed in opposite sides of the shield sidewall. A portion of each of the ribs is substantially parallel to the minor axis of the panel and in proximity to the flange. At least one of (236, 336) each pair of ribs (234, 236 and 334, 336), extends around two adjacent corners of the shield.

DETAILED DESCRIPTION OF THE PREFERRED EMBODIMENTS

Figure 2:
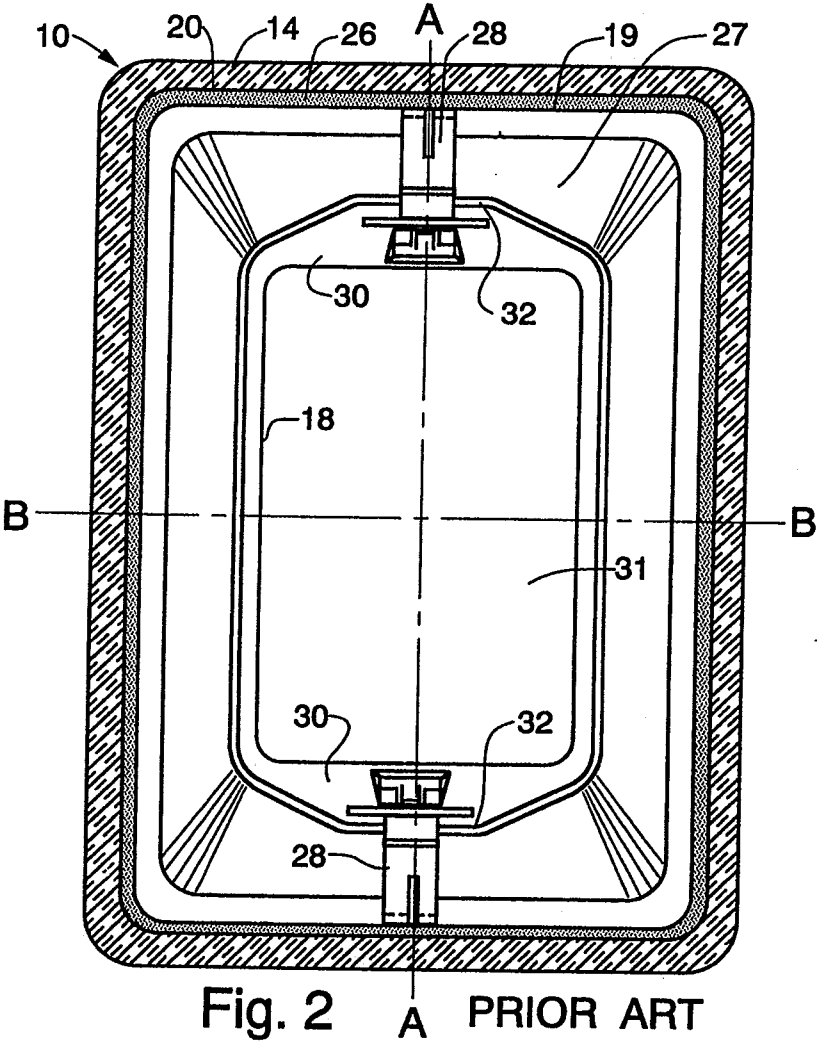
Fig. 2 PRIOR ART
FIG. 2 is a sectional view taken along line 2—2 of FIG. 1.
Figure 1:
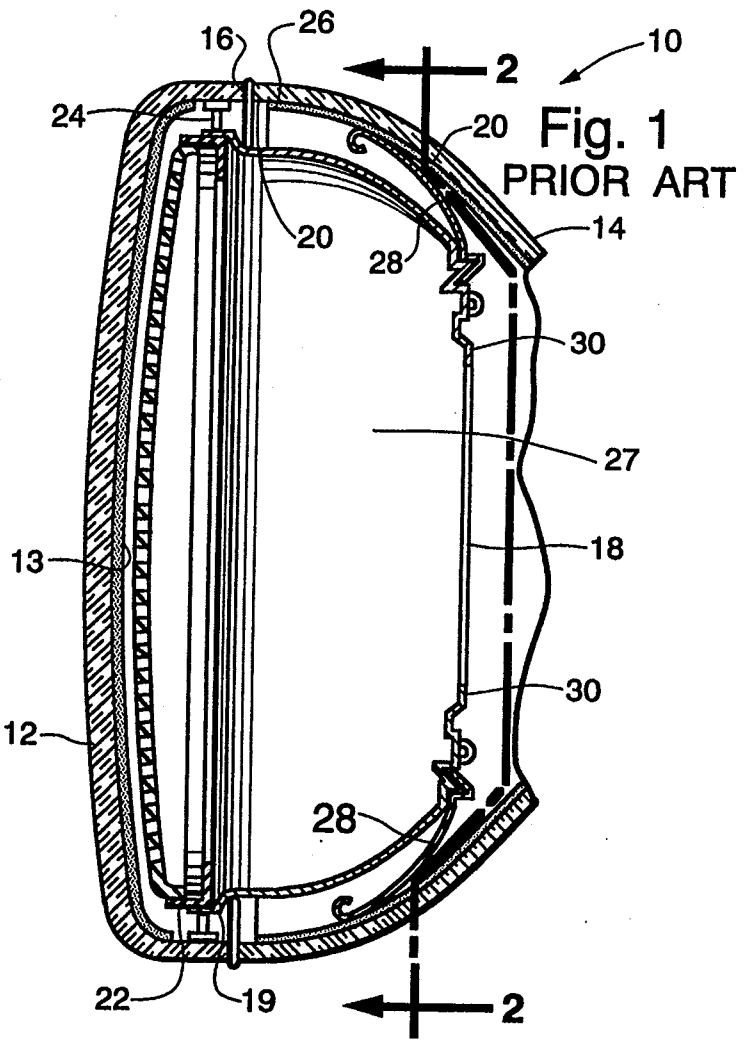
Fig. 1 PRIOR ART
FIG. 1 is a cross-sectional view illustrating a conventional faceplate panel and internal magnetic shield with contact springs positioned along the major axis within a CRT.
Figure 3:
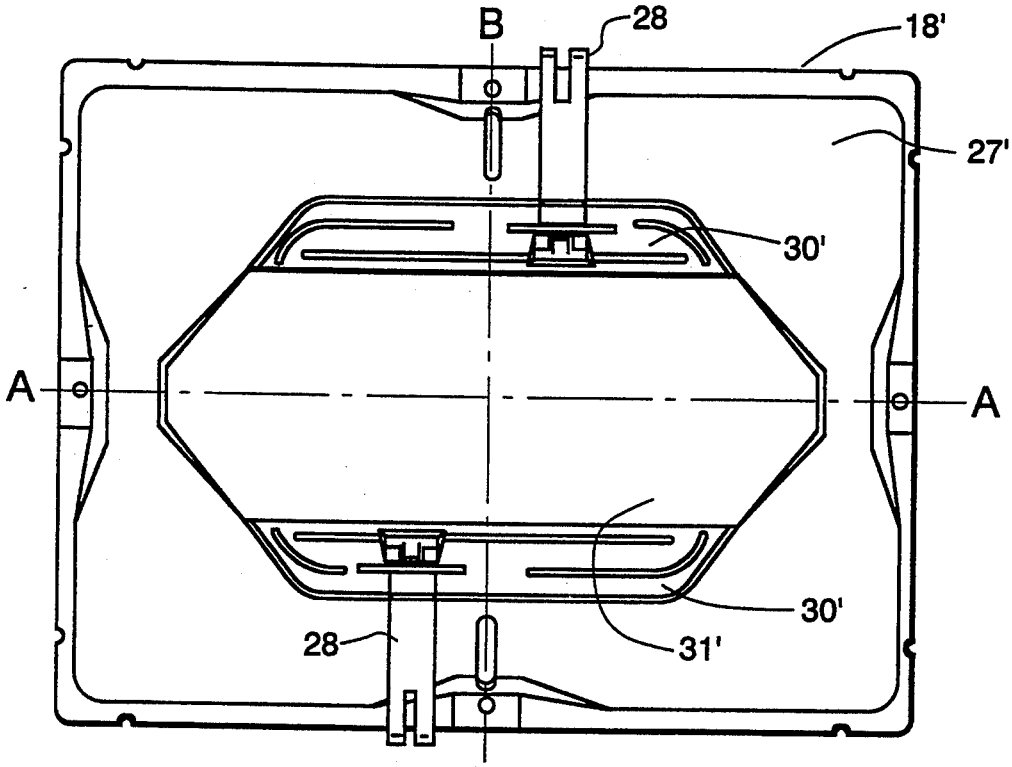
Fig. 3 PRIOR ART
FIG. 3 is a plan view of a conventional shield with V-shaped notches having contact springs positioned along the minor axis.
Figure 4:
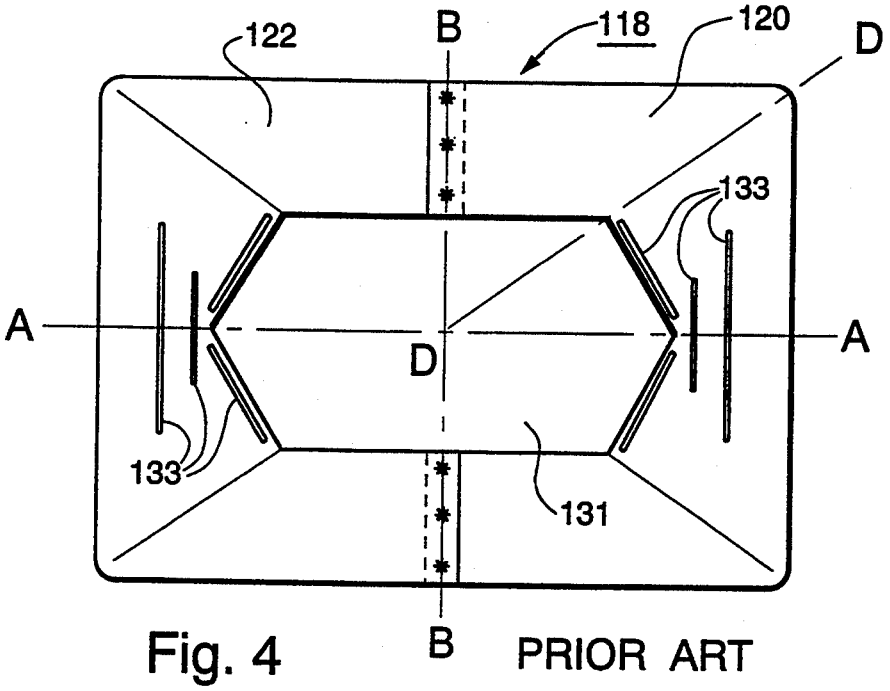
Fig. 4 PRIOR ART
FIG. 4 is a plan view of a two-piece internal magnetic shield of conventional design.
Figure 5:
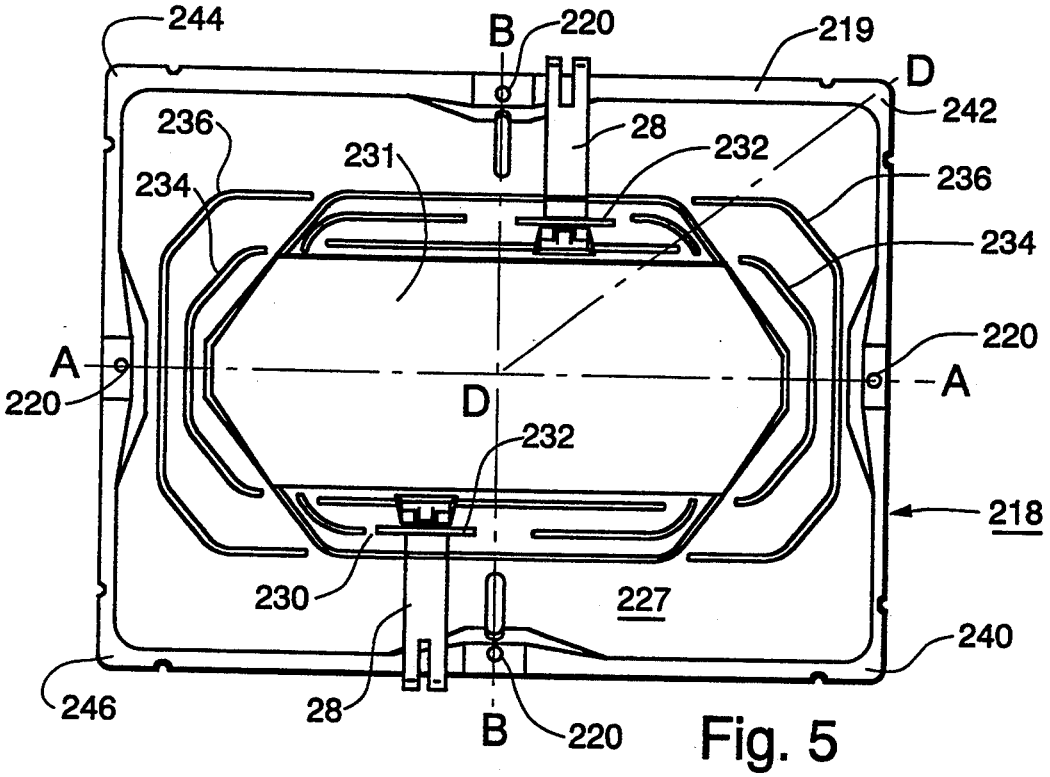
FIG. 5 is a first embodiment of an internal magnetic shield according to the present invention.
Figure 6:
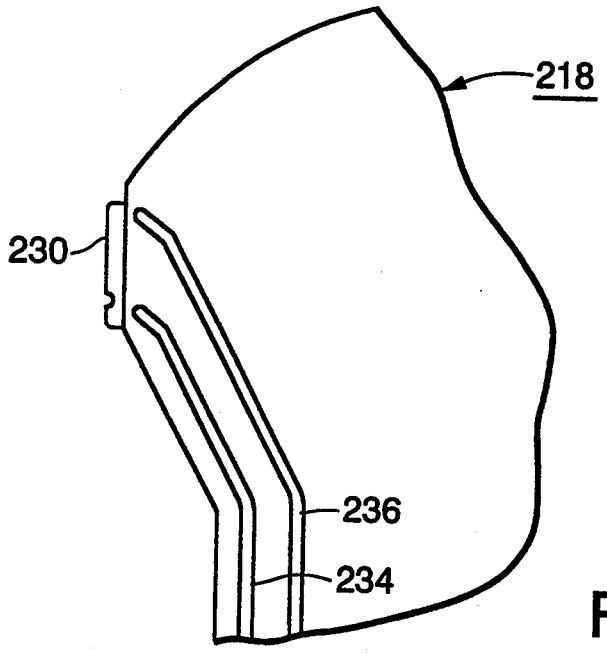
FIG. 6 is an enlarged side view of a portion of the shield shown in FIG. 5.

FIGS. 5 and 6 show a first embodiment of a novel internal magnetic shield 218 suitable for use in a color CRT of the type shown in FIG. 1. The shield is made of cold-rolled steel having a thickness in the range of 0.10 to 0.18 mm. The shield 218 has a base 219 which is fastened to the frame 22 of a shadow mask, shown in FIG. 1, by conventional clips (not shown) extending through openings 220 provided in the base 219 along the major and minor axes A—A and B—B, respectively. Spaced from the base 219 is a substantially flat, smaller rear flange 230 of the shield 218. A substantially continuous bowl-like sidewall 227, having a substantially full frontal opening, extends between the base 219 and the smaller rear flange 230. The sidewall 227 is formed in such a manner as to permit close spacing between the outer surface of the shield sidewall and the conductive coating 26 on the inner surface 20 of the tube funnel 14. An aperture 231, having a substantially rectangular central portion and V-shaped portions on opposite sides of the central portion, along the major axis A—A, is formed through the rear flange 230 to permit electron beams from an electron gun (not shown) to impinge upon the tricolor cathodoluminescent screen 13 disposed on the internal surface of the faceplate panel 12. A pair of contact springs 28 are attached to the flat rear flange 230 by means of an underpass and retaining bar 232 formed in the rear surface 230, on opposite sides of the central portion of the aperture 231. The spring retaining structure is described more fully in U.S. Pat. No. 4,670,686, referenced above.

To prevent inflection or bending of the sidewall 227 when the springs 28 are attached, or when the shield is inserted into the funnel 14, a plurality of strengthening ribs are formed in opposite sides of the sidewall. As shown in FIG. 5, each of the ribs 234 and 236 has a portion which is substantially parallel to the minor axis B—B. The ribs 234 and 236 are in proximity to the V-shaped portion of the aperture 231, formed through the rear flange 230. The ends of ribs 236 extend around the adjacent corners 240, 242 and 244, 246 as evidenced by the intersection of the ribs 236 with the diagonal line D—D. The ribs 236 terminate along the long side of the sidewall in proximity to the edge of the flange 230, remote from the aperture 231. Ribs 234 do not extend around the corners of the shield but terminate in proximity to the edge of the flange 230 adjacent to the aperture 231. Typically, for a 66 cm diagonal CRT, the shield 218 has an overall height of about 134.62 mm and a height at the narrowest portion of the V-shaped aperture 231 of about 99.57 mm. Each of the strengthening ribs 234 and 236 is concave inwardly and has a depth of about 1.57 mm and a radius of about 1.91 mm. Preferably, the ribs 234 and 236 are longitudinally spaced about 9.53 mm and 24.76 mm, respectively, from the V-shaped portion of the aperture 231 along the major axis A—A. The pairs of strengthening ribs 234 and 236 provide sufficient stiffening to the shield 218 to prevent inflection or bending of the shield both when the springs 28 are attached and also when the shield is inserted into the funnel 14.

Figure 7:
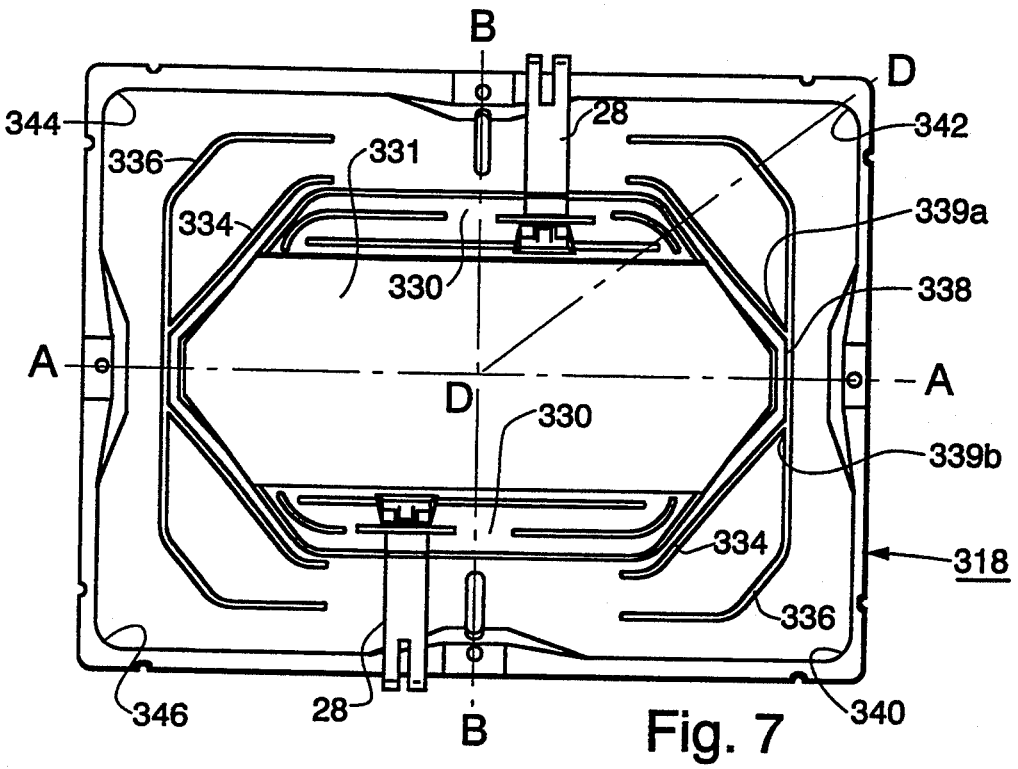
FIG. 7 is a second embodiment of an internal magnetic shield according to the present invention.
Figure 8:
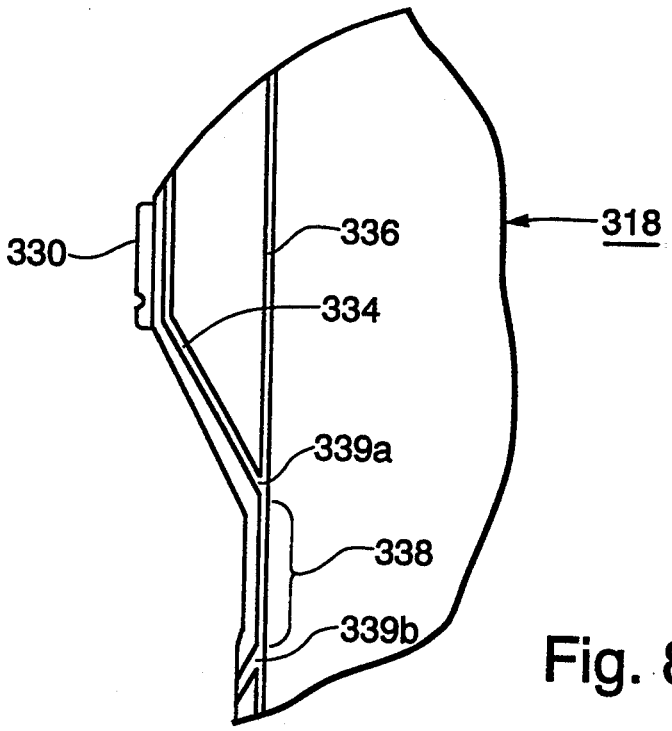
FIG. 8 is an enlarged side view of a portion of the shield shown in FIG. 7.

A second embodiment of a novel shield 318 is shown in FIGS. 7 and 8. The shield 318 is similar to the shield 218 except that the pairs of strengthening ribs 334 and 336 overlap one another adjacent the narrowest end of the V-shaped aperture 331. The overlapping portions 338 of the ribs 334 and 336 branch slightly above and below the major axis A—A at points **339*a* and 339*b*, respectively, with ribs 334 extending substantially parallel to the V-shaped portions of aperture 331 before extending around the adjacent corners 340, 342 and 344, 346 and along and substantially parallel to the long side of the shield, toward the minor axis B—B. The ribs 336 also extend around the corners 340, 342 and 344, 346 and run substantially parallel to the long side of the shield, toward the minor axis B—B. Typically, for a 66 cm diagonal CRT, the shield 318 has an overall height of about 134.62 mm and a height at the narrowest portion of the V-shaped aperture 331 of about 99.57 mm. The overlapping portions 338 of the ribs 334 and 336 are longitudinally located about 4.5 mm from the aperture 331, and the longitudinal spacing between the ribs 334 and the surface of flange 330 is about 3.07 mm, where the ribs 334 are adjacent to the rear surface. The longitudinal spacing between the ribs 336 and the surface of the flange 330 is about 34.47 mm. In this second embodiment, the ribs 336 are positioned lower on the sidewall, where they cross the corners 340, 342 and 344, 346, than are the ribs 236 of the first embodiment of the shield 218. The strengthening ribs of the second embodiment thus provide greater strength lower in the corners, i.e., closer to the base 319, than do the second 236 ribs of the first embodiment. The latter which do not overlap the first ribs 234 at the lowest portion of the V-shaped aperture, provide more support in this area, along the short side of the shield 218**.

What is claimed is:

1. In a color cathode-ray tube having a rectangular faceplate panel with a major axis and a minor axis and a viewing screen on an internal surface thereof, said panel being sealed to a funnel along an edge of a sidewall of said panel, a color selection electrode assembly being spaced from said screen and attached to said sidewall of said panel, an internal magnetic shield having a substantially rectangular base with four corners secured to said color selection electrode assembly and a flange circumscribing an aperture with a substantially continuous shield sidewall extending between said base and said flange, said shield sidewall being directed along an inner surface of said funnel, the improvement comprising said shield sidewall having two pairs of strengthening ribs formed in opposite sides thereof, said ribs being substantially parallel to the minor axis of said panel and in proximity to said flange, at least one rib extending around two adjacent corners of said shield sidewall.

2. The tube as described in claim 1, wherein said shield has two long sides substantially parallel to said major axis and two short sides substantially parallel to said minor axis, said strengthening ribs being formed primarily in said short sides of said shield sidewall.

3. The tube as described in claim 2, wherein each of said ribs extend around two adjacent corners of said shield sidewall.

4. The tube as described in claim 1, wherein said major pairs of ribs overlap one another in the vicinity of the major axis before branching above and below said axis.

5. In a color cathode-ray tube having a rectangular face plate panel with a major axis and a minor axis and a viewing screen on an internal surface thereof, said panel being sealed to a funnel along an edge of a sidewall of said panel, a color selection electrode assembly being spaced from said screen and attached to said sidewall of said panel, an internal magnetic shield having a substantially rectangular base with four corners secured to said color selection electrode assembly and a flange circumscribing an aperture with a substantially continuous shield sidewall extending between said base and said flange, said shield sidewall being directed along an inner surface of said funnel, the improvement comprising said shield sidewall having a plurality of strengthening ribs formed in opposite sides thereof, said ribs being substantially parallel to the minor axis of said panel and in proximity to said flange, at least one rib extending around two adjacent corners of said shield sidewall.

6. The tube as described in claim 5, wherein said shield has two long sides substantially parallel to said major axis and two short sides substantially parallel to said minor axis, said strengthening ribs being formed primarily in said short sides of said shield sidewall.

7. The tube described in claim 6, wherein each of said ribs extends around two adjacent corners of said shield sidewall.

8. The tube as described in claim 5, wherein said plurality of ribs overlap one another in the vicinity of the major axis before branching above and below said major axis.

* * * * *